US007383809B2

(12) United States Patent
Rosendahl et al.

(10) Patent No.: US 7,383,809 B2
(45) Date of Patent: Jun. 10, 2008

(54) FASTENING DEVICE AND METHOD FOR FASTENING A COMPONENT PART IN AN OIL SUMP

(75) Inventors: Marco Rosendahl, Wiehl (DE); Markus Beer, Morsbach (DE)

(73) Assignee: IBS Filtran Kunstatoff-/Metallerzeugnisse GmbH, Morsbach (DE)

( * ) Notice: Subject to any disclaimer, the term of this patent is extended or adjusted under 35 U.S.C. 154(b) by 0 days.

(21) Appl. No.: 11/446,361

(22) Filed: Jun. 5, 2006

(65) Prior Publication Data

US 2007/0017745 A1 Jan. 25, 2007

(30) Foreign Application Priority Data

Jun. 4, 2005 (DE) ..... 10 2005 025 726

(51) Int. Cl.
*F01M 11/03* (2006.01)

(52) U.S. Cl. ..... 123/198 E; 210/455; 184/6.24; 123/196 A

(58) Field of Classification Search ..... 123/195 C, 123/198 E, 196 R, 196 A; 184/6.24, 6.5, 184/6.25; 210/172.2, 455
See application file for complete search history.

(56) References Cited

U.S. PATENT DOCUMENTS 4,615,314 A * 10/1986 Baugh ..... 123/195 C
5,934,241 A * 8/1999 Von Esebeck et al. .. 123/196 R
6,488,844 B2 * 12/2002 Willis et al. ..... 210/172.2
7,128,218 B2 * 10/2006 Rosendahl et al. ..... 210/455

FOREIGN PATENT DOCUMENTS

DE 10313447 A1 * 10/2004
WO WO0246584 6/2002

* cited by examiner

*Primary Examiner*—Stephen K. Cronin
*Assistant Examiner*—Hyder Ali
(74) *Attorney, Agent, or Firm*—Baker & Hostetler LLP

(57) ABSTRACT

A fastening device and a method of fastening a component part in an oil pan are described. For easy and still secure mounting, the invention provides a fastening device that consists of a base part and, disposed thereon, of at least one holding part for establishing a preferably reversibly releasable, substantially shape-mating connection with a component part, the base part being connected to the oil pan, the holding part being a constituent part of the base part and the holding part being bendable over a fold region.

17 Claims, 4 Drawing Sheets

FASTENING DEVICE AND METHOD FOR FASTENING A COMPONENT PART IN AN OIL SUMP

CROSS-REFERENCE TO RELATED APPLICATIONS

This application claims priority to German Patent Application No. 10 2005 025 726.7, filed Jun. 4, 2005, all of the disclosure of which is hereby incorporated by reference in its entirety.

FIELD OF THE INVENTION

The invention relates to a fastening device and to a method for fastening a component part in an oil pan, more specifically in a metallic oil pan.

BACKGROUND OF THE INVENTION

Fastening devices for mounting a component part in an oil pan are known. WO 02/46584 A1 discloses for instance a metal oil pan with integrated oil filter in which the oil filter is mounted in the oil pan through a fastening means. In one embodiment, the shell of the oil filter is, for this purpose, fastened directly to the oil pan by means of rivets. Alternatively, in a second embodiment, rivets, to the ends of which fastening straps for fixing by clamping the housing of the filter in the oil pan are attached, are inserted. These embodiments have the disadvantage that a plural number of work steps are needed to establish the connection between the oil pan and the oil filter. Further, since holes for inserting the rivets must be made, potential tolerances with regard to the attachment points can only be accommodated at high expense because of the form of the oil filter or the oil pan.

SUMMARY OF THE INVENTION

It is the object of the invention to provide a fastening device for component parts in oil pans that makes it possible to readily accommodate fastening tolerances, to readily mount the fastening device in the oil pan and to readily insert the component part so as to provide a registration fit.

With regard to the fastening device, the solution to this object is achieved in that the fastening device consists of a base part and, disposed thereon, of at least one holding part for establishing a preferably reversibly releasable, substantially shape-mating connection with a component part, said base part being connected to the oil pan, said holding part being a constituent part of said base part and said holding part being bendable over a fold region.

In this way, a readily achievable connection between the component part and the oil pan is achieved. By adapting the holding element, which is bendable over the fold region, tolerances can be optimally accommodated. A connection between base part and oil pan is readily achievable, such as by welding. Further, the component part can directly register with and engage the fastening device.

It is particularly practical that the base part be a sheet metal strip. Such sheet metal strips can be manufactured at low cost and can be readily provided with fold regions. The base part, more specifically the sheet metal strip, can thereby consist of singular portions that may be disposed on a plurality of regions of the oil pan for fastening one or a plurality of component parts, or can be configured to be a closed ring in order to optimally match a respective one of the component parts.

Further, in a preferred developed implementation of the invention, the component part is intended to have a catch portion. About this catch portion, a connection between the connection element and the component part can be achieved in a particularly simple manner by bending the holding part. The catch portion thereby advantageously constitutes the outer contour of the component part since it makes it possible for the holding part to form a particularly good surrounding grip in this region. Also, the form of the base part is advantageously adapted to the shape of the catch portion of the component part in order to produce the best possible connection.

It is further advantageous that, in portions, the holding part matingly encompasses the catch portion of the component part. Alternatively, the holding part encompasses completely the catch portion of the component part. A particularly tight connection between component part and oil pan is hereby possible.

In another preferred configuration of the invention, a seal is provided between the base part and the catch portion. The seal may thereby be inserted into the fastening part. A seal may also be provided between base part and oil pan. The seal may be readily inserted since it merely needs to be inserted between the base body and the catch portion or the oil pan, respectively. Advantageously, the seal is an adhesive.

Further, the invention is advantageously improved in that the connection between the oil pan and the base part is established by means of an adhesive. An adhesive can be applied in an easy and variable manner and in particular so as to mate the shape of the component part. The very bonding allows for more accurate positioning of the component part since on the one side the bonding region is directly dictated by embossments provided on the oil pan surface. Alignment of the fastening device is also possible in a very easy manner since the component part remains movable for a limited time until, as a result of the adhesive being cured, the maximum holding force is achieved. Further, application of the adhesive and subsequent mounting of the fastening device significantly reduce the production steps. As a result, the fastening device can be mounted before or after the oil pan is processed, irrespective of the process steps.

The adhesive permits not only to achieve the holding forces but also to seal still existing potential leaks. For this purpose, the adhesive is applied advantageously both for sealing and for fastening in shape of a caterpillar.

Moreover, there is provided in the invention that one fastening element is adapted for fastening simultaneously two or more component parts. For this purpose, it is particularly advantageous if holding parts are disposed on confronting sides of the base body.

The oil pan advantageously is an oil pan for internal combustion engines or for an automatic transmission in an automotive vehicle. The component part may be an oil filter unit, a magnet, a sensor, a pump or the like.

With regard to the method, the object is achieved by means of the following steps:

Bonding a base part of a fastening device according to any one of the claims 1 through 20 into the oil pan, inserting the component part and bending the at least one holding element about the at least one catch portion of the component part.

This method provides a possibility of readily establishing a connection between the component and the oil pan. It is thereby possible to mount the fastening device to the oil pan any time during manufacturing or processing.

BRIEF DESCRIPTION OF THE DRAWINGS

The invention will be further described herein after with reference to an exemplary embodiment illustrated in the drawing. In said drawing, the various figures schematically show.

DETAILED DESCRIPTION OF THE INVENTION

Figure 1:
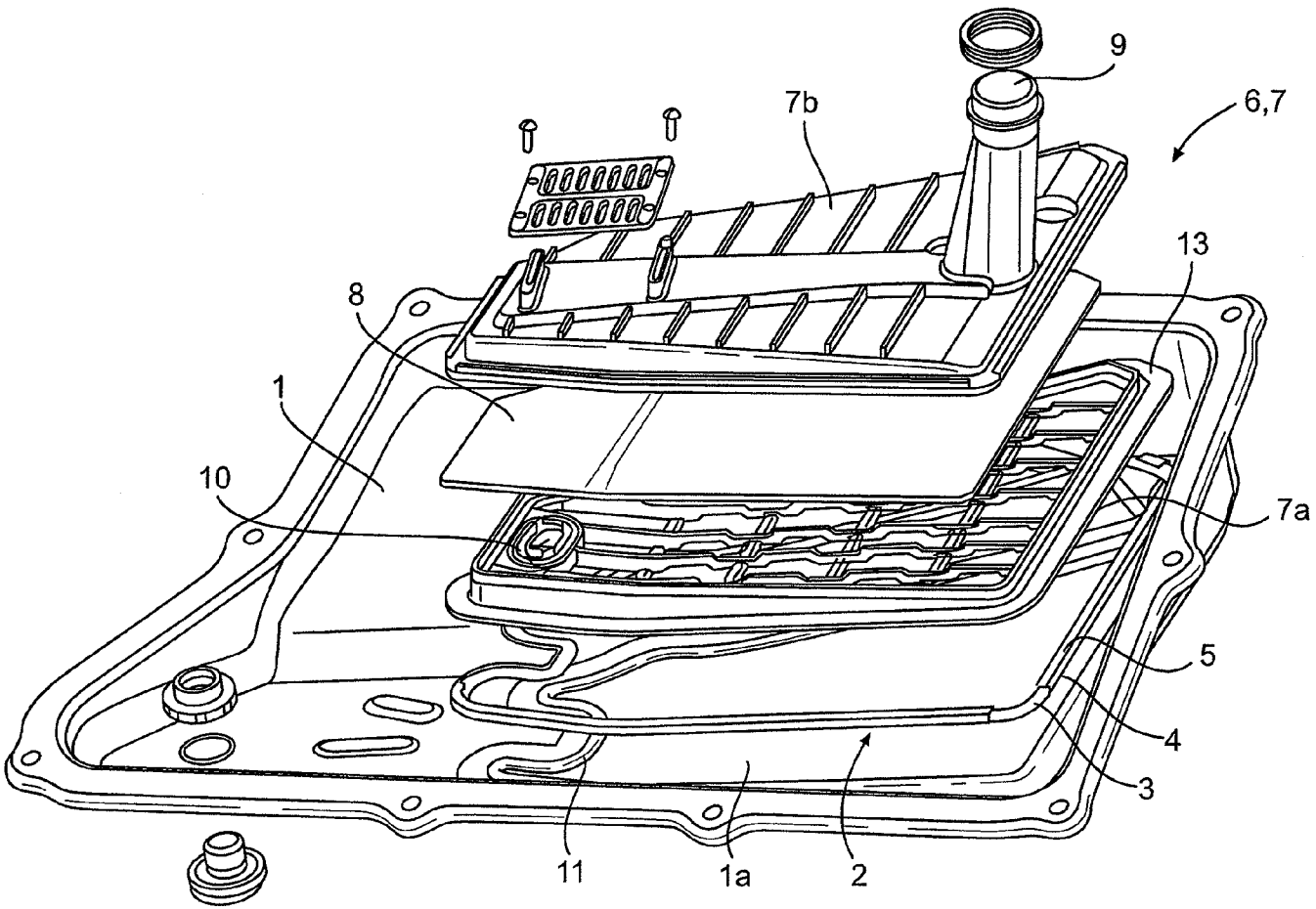
FIG. 1 an exploded view of an oil pan with a fastening device of the invention, FIG. 2 a cross-sectional view of the oil pan of FIG. 1, FIG. 3 detail III of FIG. 1 to an enlarged scale, which is a portion of a fastening device of the invention, FIG. 4 a three-dimensional view of a portion of a fastening device of the invention with an integral holding part, FIG. 5 an embodiment of the fastening device of the invention with an interrupted holding part and suitable for mounting two component parts to a fastening device, and FIG. 6 a cross-sectional view of a detail of an oil pan in accordance with another exemplary embodiment.

FIG. 1 shows an exploded view of an oil pan 1 made from metal. A fastening device 2, which has a base part 3 and holding parts 5 connected together through a fold region 4, is mounted thereon. The holding parts 5 are disposed by portions on the base part 3; it is however also possible to provide for a completely perimetric holding part 5. The fastening device 2 is made from sheet metal and has, when viewed in cross-section, substantially two legs and one portion joining said legs, with the one leg being configured to be the base part 3 and the other leg, the holding part 5. In the mounted state, the joining portion forms a fold region 4 when the holding part 5 has been folded. Thanks to the deformability of the sheet metal, the holding parts 5 are adapted to be folded relative to the base part 3 in the manner of a sheet metal tongue or flared flange whilst the base part 3 is solidly mounted to the floor of the oil pan 1 made from sheet metal.

The fastening device 2 serves for fastening an oil filter unit 6 in the oil pan 1. The oil filter unit 6 has a housing 7 made from plastic material, said housing consisting of a bottom filter shell 7*a* and of a top filter shell 7*b*. A filter medium 8 is inserted between bottom filter shell 7*a* and top filter shell 7*b*. An oil outlet 9 is located on the top filter shell 7*b*. An oil inlet 10 is disposed on the bottom filter shell.

The oil is drawn from the oil pan through the oil inlet 10 into the bottom filter shell 7*a*, passes through the filter medium 8 into the top filter shell 7*b* and is recirculated from there through the oil outlet 9 into the circuit. Filtered residues deposit thereby in the bottom filter shell 7*a*.

In the bottom of the oil pan 1 there is formed a substantially planar mounting surface 11 onto which the fastening device 2 is mounted. The mounting surface is formed in the oil pan 1 in the shape of an embossment and projects into the interior of the oil pan 1. The contour of the mounting surface corresponds to the outer rim of the oil pan 1 and the fastening device 2 is mounted accordingly along the outer rim of the oil pan. In the neighborhood of the inner side of the mounting surface 11 there is disposed a bulge 12 serving to position the bottom filter shell 7*a* into place during mounting. The bottom filter shell 7*a* of housing 7 is configured to be open towards the bottom so that a closed unit forms with the housing parts 7*a* and 7*b* through the region of the oil pan bottom 1*a* inside the mounting surface 11.

Figure 2:
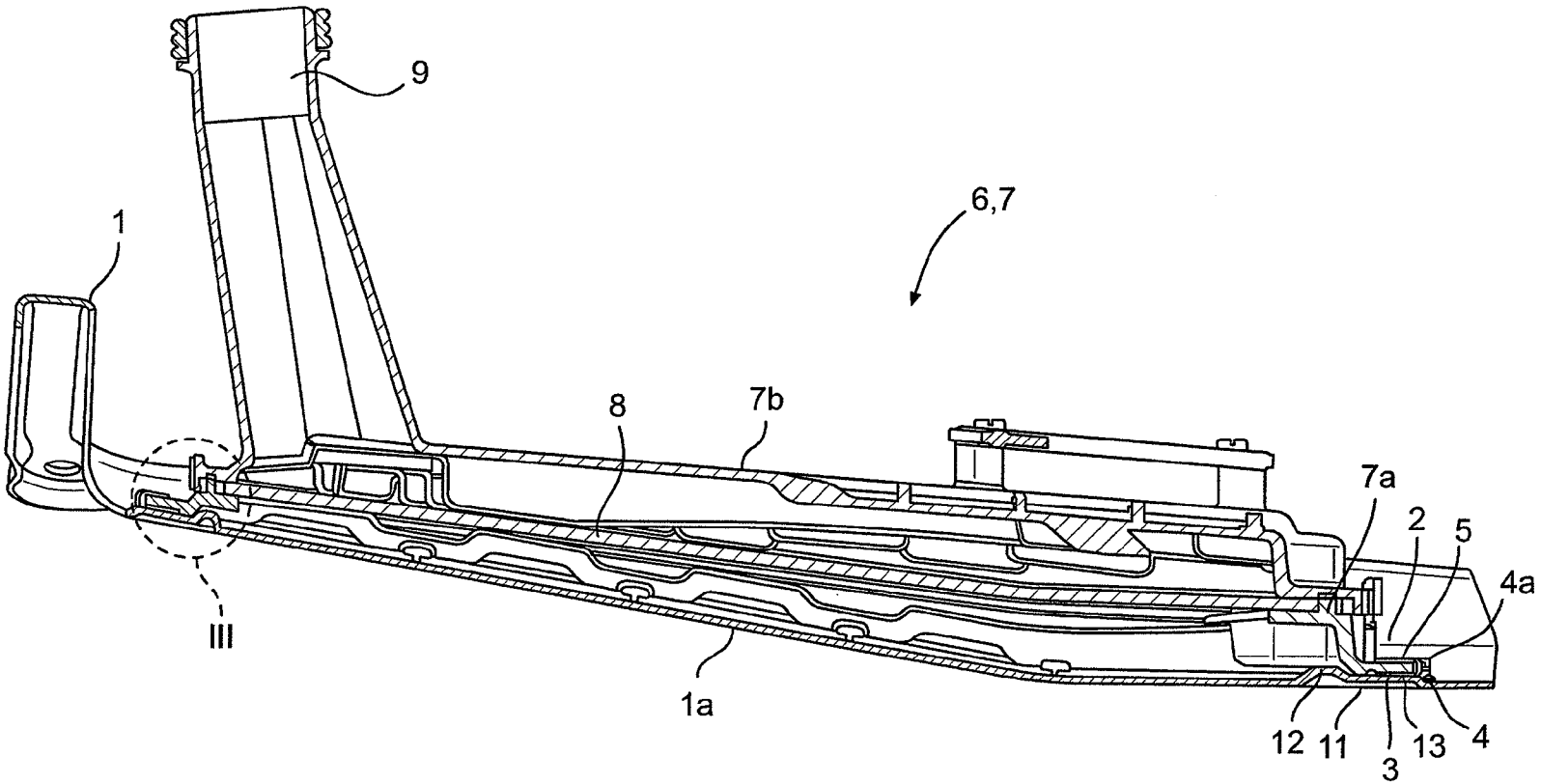
Figure 3:
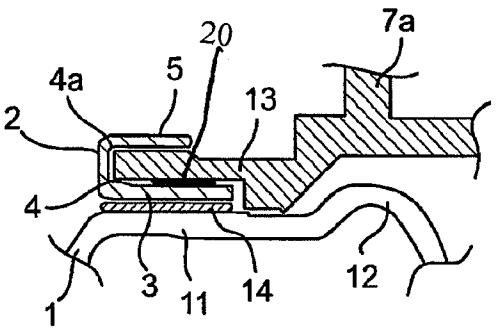

On the bottom filter shell 7*a* there is provided a protruding rim surrounding completely the perimeter of the bottom filter shell 7*a* and constituting the outer contour, said rim performing the function of the catch portion 13. The rim or catch portion 13 can be configured directly on the bottom filter shell 7*a* or indirectly by the fact that it is configured on a separate carrier frame to which the bottom filter shell 7*a* is fastened. Upon inserting the oil filter unit 6 into the fastening device 2, the rim is placed onto the base part 3 and then, the holding part 5 is bent about the shoulder of the catch portion 13 that is turned away from the oil pan bottom so as to provide a shape-mating connection. The fold region 4 forms a surrounding grip around the rim on the side thereof so that the housing 7 is also retained laterally in the position dictated. For ease of bending and of forming the fold region 4 in the dictated position, there is provided a fold line 4*a* that is located on the holding part along the dictated position of the upper edge of the catch portion 13 and along which the holding part 5 is bent onto the catch portion 13. This can be seen from FIG. 2 and in particular in FIG. 3 where it is shown to an enlarged scale. The fastening device 2 forms a framing flange that surrounds the perimeter of the oil filter unit 6 and retains the oil filter unit 6 by its projecting rim on the bottom of the oil pan1.

To fasten the fastening device 2 onto the oil pan 1, an adhesive 14 is inserted between the base part 3 and the mounting surface 11, The adhesive 14 may be applied locally or continuously around the perimeter in shape of a caterpillar. Bonding permits to achieve precise positioning of the framing flange formed by the fastening device 2 so that the oil filter unit can be positioned in the oil pan with the corresponding accuracy. If, like in the exemplary embodiment shown, the base part 3 and the mounting surface 11 are configured to completely surround the perimeter in shape of a closed ring and are mated to the outer contour of the oil filter unit 6, an uninterrupted sealing bond between the bottom filter shell 7*a* and the mounting surface 11 may also permit to seal the cavity between the bottom filter shell 7*a* and the oil pan bottom region 1*a* located underneath. The advantage thereof is that no undesirable deposit such as oil sump is allowed to accumulate. The best sealing is achieved if the adhesive is applied in shape of a caterpillar. This sealing effect may also be achieved or even enhanced if adhesive (not shown) is inserted between the base part 3 of the fastening device 2 and the catch portion 13. Additional holding forces between the oil filter unit 6 and the oil pan 1 can be achieved by providing an adbesive 20 bond between the catch portion 13 and the base part 3.

Figure 4:
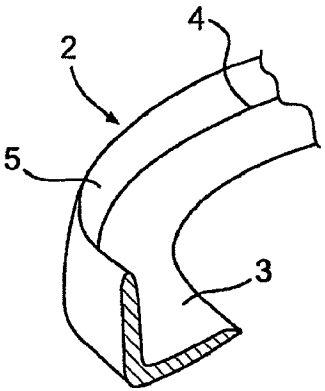
Figure 5:
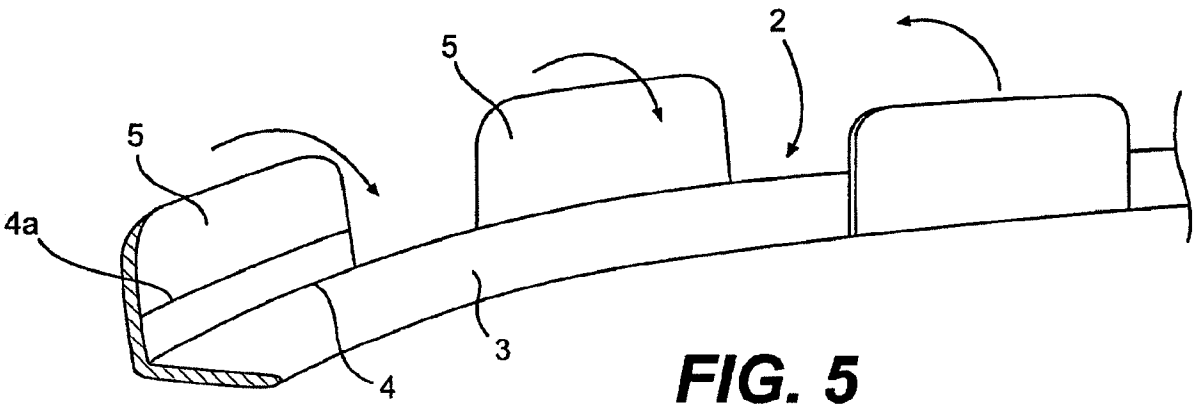

The FIGS. 4 and 5 show a portion of two possible embodiments for spanning the curved portions of the outer contour of a component part. In FIG. 4, the holding part 5 has been configured to be a single integral piece extending along the curve whereas in FIG. 5, the holding parts 5 are interrupted in the curve region.

FIG. 5 further shows the fold line 4*a* along which folding over a catch portion 13 of a component part occurs. The holding parts 5 are disposed on either side of the base part 3 of the fastening device 2 in order to make it possible to mount at least two component parts (not shown) to one fastening device 2. The holding parts 5 are bent pursuant to the arrows in FIG. 5 in order to achieve a connection between the component part and the oil pan. Component parts may not only be oil filter units but also magnets for attracting metal wear particles out of the oil, sensors or pumps for delivering the medium.

Figure 6:
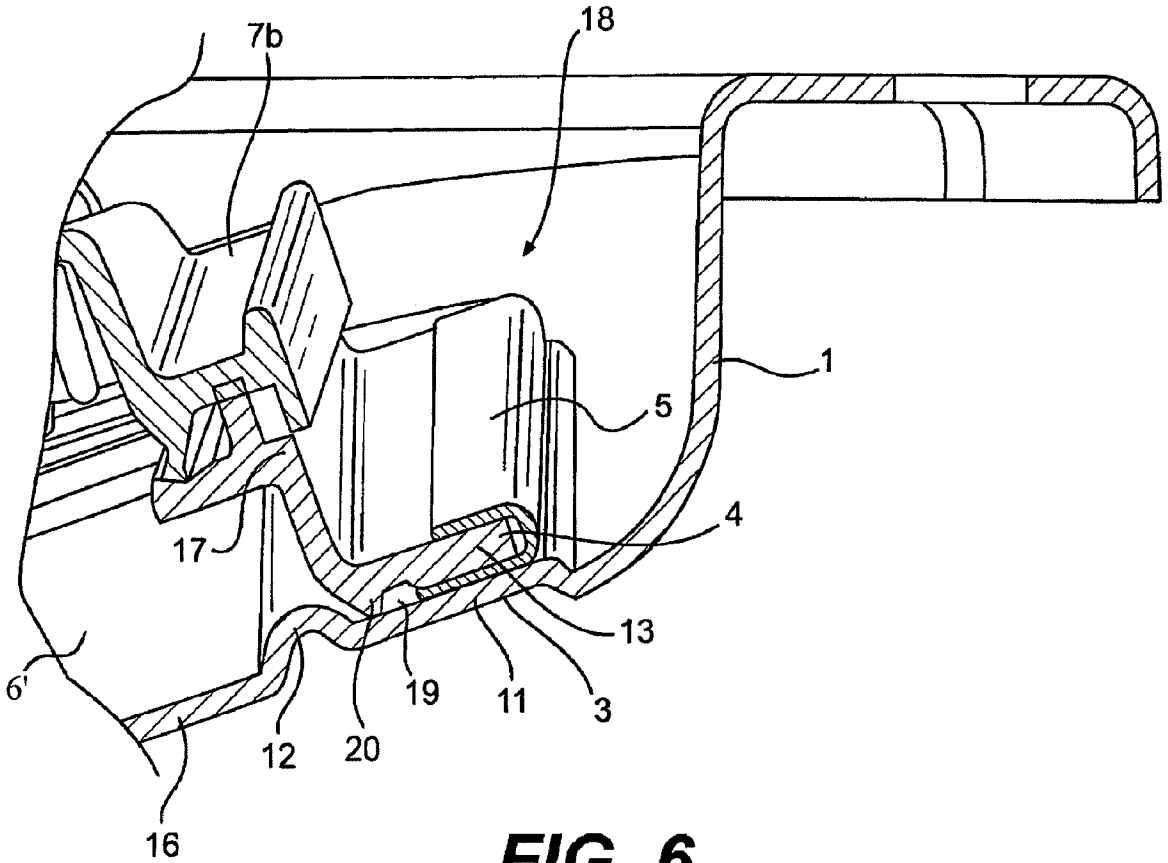

In FIG. 6, an alternative implementation for bonding the fastening device 2' into the oil pan 1 is shown. FIG. 6 further shows an alternative embodiment of the oil filter unit 6'.

Parts carried forward from the embodiments described herein above are similarly labelled.

The oil filter unit 6' is formed from the top filter shell 7*b*, a bottom region 16 of the oil pan 1 and a carrier frame 17 tightly connecting the top filter shell 7*b* and the bottom region 16 of the oil pan 1. Through a framing flange 18 having the base part 3, the fold 4 and the holding part 5 as described herein above, the carrier frame 17 is connected to the metal oil pan 1 along the entire perimeter of the top filter shell 7*b*. A filter medium (not shown) is disposed in the inner volume of the oil filter unit 6', said inner volume being formed by the bottom region 16, the framing flange 18 and the top filter shell. Carrier frame 17 and top filter shell 7*b* are each made from plastic material and are tightly connected together in a known manner.

The framing flange 18 is welded to the oil pan 1 by its base part 3. Behind the free end of the base part 3 and parallel thereto, a groove 19 which is open toward the mounting region 11 is provided in the base part. On the side turned away from the base part 3, the groove 19 is bounded by a rim 20 that rests on the mounting region 11 in the neighborhood of the bulge 12. An oil-tight adhesive is inserted into the region formed by the groove 19, the rim 16 and the mounting region 11 so that the base part 3 sealingly connects to the mounting region 11 over the entire length of the framing flange 18. The bulge 12 in turn serves to pre-fix and pre-position the carrier frame 17 on the one side and on the other side to keep adhesive from penetrating into the inner volume of the oil filter unit 6', which is not desired.

What is claimed:

1. A fastening device for fastening a component part in an oil pan, comprising:

a base part defining a continuous groove between the base part and the pan proximate to a continuous perimeter of the base part;

at least one holding part disposed on the base part for establishing a reversibly releasable, substantially shape-mating connection with the component part, the base part being connected to said oil pan by the holding part, the holding part being a constituent part of the base part and the holding part being bendable over a fold region; and a continuous first seal disposed in the groove to completely seal the perimeter of the base part to the pan.

2. The fastening device as set forth in claim 1, wherein the base part is a sheet metal strip.

3. The fastening device as set forth in claim 2, wherein the sheet metal strip is configured to be a ring.

4. The fastening device as set forth in claim 1, wherein the component part has a catch portion.

5. The fastening device as set forth in claim 4, wherein the catch portion constitutes the outer contour of the component part.

6. The fastening device as set forth in claim 4, wherein the shape of the base part is mated to the catch portion.

7. The fastening device as setforth in claim 4 wherein, the holding part matingly encompasses the catch portion of the component part by portions.

8. The fastening device as set forth in claim 4, wherein the holding part matingly encompasses the catch portion of the component part completely.

9. The fastening device set forth in claim 4, wherein a second seal is provided between the base part and the catch portion.

10. The fastening, device as set forth in claim 9, wherein the second seal is an adhesive.

11. The fastening device as set forth in claim 10, wherein the adhesive is applied in shape of a caterpillar.

12. The fastening device as set forth in claim 1, wherein the first seal is an adhesive disposed in the groove.

13. The fastening device as set forth in claim 1, wherein holding parts are disposed on confronting sides of the base body.

14. The fastening device as set forth in claim 1, wherein two or more component parts can be fastened simultaneously with one fastening element.

15. The fastening device as set forth in claim 1, wherein the component part is a filter unit.

16. The fastening device as set forth in claim 15, wherein the filter unit is an oil filter unit.

17. A method of fastening a component part in an oil pan, using a fastening device as set forth in claim 1, comprising:

inserting the component part; and bending the at least one holding element about the at least one catch portion of the component part.

* * * * *